United States Patent [19]

Rausing

[11] Patent Number: 4,560,567

[45] Date of Patent: Dec. 24, 1985

[54] METHOD FOR THE PREPARATION AND PACKING OF FOOD PRODUCTS, IN PARTICULAR FISH PRODUCTS, OF LONG KEEPING QUALITY

[75] Inventor: Hans A. Rausing, Lund, Sweden

[73] Assignee: Tetra Pak Developpement SA, Pully, Switzerland

[21] Appl. No.: 604,448

[22] Filed: Apr. 30, 1984

Related U.S. Application Data

[63] Continuation of Ser. No. 315,544, Oct. 27, 1981, abandoned.

[30] Foreign Application Priority Data

Oct. 30, 1980 [SE] Sweden ..... 8007631

[51] Int. Cl.[4] ..... A23L 3/22; A23L 3/00; B65B 55/04; B65B 55/12

[52] U.S. Cl. ..... 426/399; 426/232; 426/414; 426/513; 426/516; 53/440; 53/122; 53/517; 53/514; 53/530

[58] Field of Search ..... 426/399, 414, 413, 513, 426/516, 517, 232, 400, 401; 53/517, 519, 513, 514, 516, 518, 122, 522, 529, 530, 260, 262, 440

[56] References Cited

U.S. PATENT DOCUMENTS

| | | | |
|---|---|---|---|
| 1,486,748 | 3/1924 | Hilgers | 53/519 |
| 1,881,171 | 10/1932 | Cooley | 426/513 |
| 2,054,937 | 9/1936 | Kremer | 426/245 |
| 2,481,690 | 9/1949 | Schaub | 426/516 |
| 2,517,569 | 8/1950 | Huzenlaub | 426/399 |
| 2,630,390 | 3/1953 | Carruthers | 426/513 |
| 2,670,296 | 2/1954 | Tansley | 426/513 |
| 2,683,932 | 7/1954 | Steenhuis | 17/32 |
| 2,953,461 | 9/1960 | Prohaska | 426/246 |
| 3,041,185 | 6/1962 | Mck Martin | 426/399 |
| 3,113,530 | 12/1963 | Vestermark | 53/516 |
| 3,124,469 | 3/1964 | Carruthers | 426/513 |
| 3,179,041 | 4/1965 | Luthi et al. | 53/517 |
| 3,232,770 | 2/1966 | Schack et al. | 426/401 |
| 3,433,647 | 3/1969 | Johnston | 426/513 |
| 3,437,495 | 4/1969 | Jeppson | 426/400 |
| 3,468,026 | 9/1969 | Robertson et al. | 426/491 |
| 3,542,564 | 11/1970 | Cornwell | 426/643 |
| 3,563,764 | 2/1971 | Posegate | 426/414 |
| 3,721,060 | 3/1973 | Quinto | 53/576 |
| 3,730,740 | 5/1973 | Schack et al. | 426/513 |
| 3,863,017 | 1/1975 | Yueh | 426/513 |
| 3,889,013 | 6/1975 | Moule | 426/513 |
| 3,891,779 | 6/1975 | Robinson | 426/399 |
| 3,959,505 | 5/1976 | Valiant | 426/513 |
| 4,019,547 | 4/1977 | Ross | 53/530 |
| 4,052,836 | 10/1977 | Shaw | 426/414 |
| 4,068,008 | 1/1978 | Orchard | 426/513 |
| 4,113,890 | 9/1978 | Long | 426/516 |
| 4,166,140 | 2/1979 | Dutton et al. | 426/513 |
| 4,175,140 | 11/1979 | Bachmann et al. | 426/399 |
| 4,233,320 | 11/1980 | Monaco et al. | 426/399 |
| 4,260,640 | 4/1981 | Hartmann et al. | 426/516 |

*Primary Examiner*—Steven Weinstein

*Attorney, Agent, or Firm*—Burns, Doane, Swecker & Mathis

[57] ABSTRACT

A method for the preparation and packing of food products, in particular fish products of long keeping quality, includes disintegrating and sterilizing the fish and allowing the sterilized fish mass to coagulate under pressure in a forming and filling pipe. An inside cross-section of the filling pipe corresponds to the cross-section of the packing container wherein the product is to be packed. The forming and filling pipe is provided, moreover, with cut-off elements and flaplike shut-off elements to make possible the separation and feeding out of the product from the forming and filling pipe to the packing containers.

3 Claims, 3 Drawing Figures

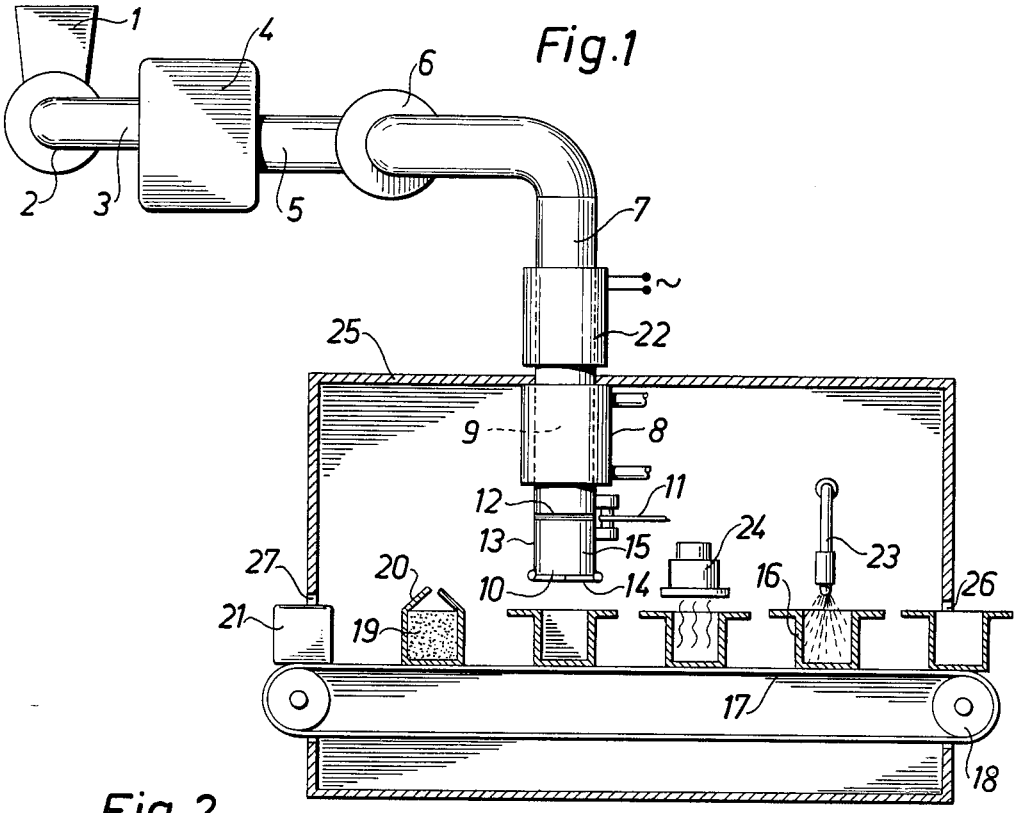
Fig.1
Fig.2
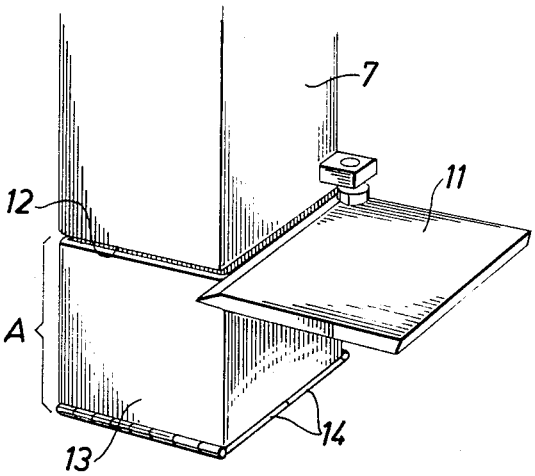
Fig.3
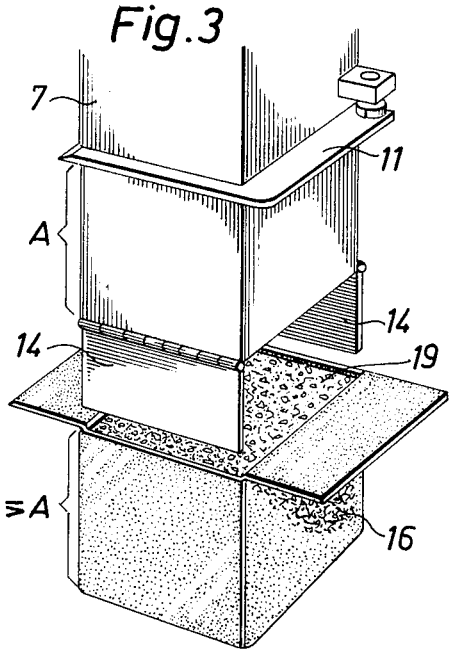

METHOD FOR THE PREPARATION AND PACKING OF FOOD PRODUCTS, IN PARTICULAR FISH PRODUCTS, OF LONG KEEPING QUALITY

This application is a continuation, of application Ser. No. 315,544, filed Oct. 27, 1981, now abandoned.

BACKGROUND AND SUMMARY OF THE PRESENT INVENTION

The present invention relates generally to a method for the preparation and packing of food products. More specifically, the present invention relates to the preparation and packaging of a product based on fish, which through sterilization has been given an extended keeping quality. The product is disintegrated and heated in a known manner to such an extent that the product becomes sterile.

It is known in foodstuff technology that food products can be treated through sterilization so that they acquire an extended keeping quality. For the most part this sterilization takes place by means of heat in such a manner that the product is heated to a temperature generally exceeding 140° C. for a time which may vary between a few seconds and some minutes, depending on the product which is to be sterilized. Usually such a sterilization takes place after the food product has been packed in hermetically closed containers, e.g. tins, the sterilization taking place in a so-called autoclave, wherein the closed tins are heated during a time which is long enough for the contents of the tins as well as the insides of the tins to become sterile. It is known that such sterilized tins have a very long keeping quality, but it is an inconvenience that the autoclaving principle is so time-consuming and costly. Moreoever, due to the required long-time heating the product often acquires a disagreeable flavor because of the protein substances of the product are denatured during the long-time heating.

It is also known that products can be sterilized separately and then packed into previously sterilized packages. This is done e.g. in the packaging of so-called aseptic milk, where the milk is briefly heated to approx. 140° C. during a few seconds. Subsequently, the milk is introduced, under aseptic conditions, into previously sterilized packing containers or enclosed in previously sterilized packing material in such a manner, that the finished package on the one hand has a sterile inside and on the other hand sterile contents. Thus, the packed milk is given a keeping quality which can extend over several months.

It has not been possible heretofore to apply this separate sterilization of food products for subsequent packing in presterilized packing containers to those types of contents which have a certain dimensional stability, that is to say coagulated products of the type of aspic, sausage-meat or fish products of the quenelle type or other pie-like fish product. The problem in such a package consists in producing the sterilized product in a form which corresponds to the inner space in a previously sterilized packing container, and subsequently combining the formed product with the packing container. Finally, closing the packing container under aseptic conditions to obtain a package with sterile interior, wherein the sterilized product retains its sterility is also a problem. A method and an arrangement for solving this problem is given in the following description of the present invention wherein the product in connection with or after the sterilizing heating is divided into portions which are each given an outer shape and size which correspond to or are slightly less than the space in the packing container intended for the product. The packing container is treated in such a manner that its insides become sterile, and the product, divided into portions and sterilized, is introduced into the sterilized packing containers, which are closed under aseptic conditions to form individual packages containing sterile product.

BRIEF DESCRIPTION OF THE DRAWINGS

An embodiment of the invention will be described in the following with reference to the enclosed schematic drawings wherein:

FIG. 1 in a schematic view of the operation of preparing and packaging of the product in accordance with the present invention;

FIG. 2 is a perspective view of the feeding and forming pipe in accordance with the invention, and FIG. 3 is a perspective view of the pipe of FIG. 2 in a different operational position.

DETAILED DESCRIPTION OF THE PREFERRED EMBODIMENT

The invention can be applied, of course, to a great number of different food products, such as meat and fish, but for the sake of simplicity it will be assumed in the present case that the product treated is fish. The fish, after washing and possibly cleaning, is introduced in the mixing chamber 1 to the grinding mill 2 where the fish is milled to relatively finely divided particles (0.5–5 mm). It is also possible to add to the fish mass a coagulating agent, e.g. alginates or water-absorbing substances, e.g. rice meal. The fish mass discharged from the grinding mill 2 to the pipeline or mixing chamber 3 coagulates wholly or partly, or at least assumes a solid or semisolid form, if the disintegrated product is not agitated. In certain cases it is appropriate to allow the product to coagulate or to solidify in a chamber, not shown here, which may be constituted of an extension of the pipe 3. If the coagulation has been carried on for too long, the product in such cases must be disintegrated again e.g. by milling in a grinding mill, not shown here, before it is introduced into the heat treatment chamber 4 in which it is heated for sterilization. The heat treatment chamber 4 may be constituted of a so-called "scraping heat exchanger" which consists of a cylindrical space, wherein rotating scrapers continuously operate along the walls of the space so as to remove the product from the walls. The walls are hot owing to their being heated from the outside, e.g. by means of superheated steam. In the "scraping heat exchanger" 4 the product is heated with simultaneous intensive agitation so that all parts of the product attain the sterilizing temperature (approx. 140° C.) within a few minutes thereby all bacteria and micro-organisms of the product are rendered innocuous. From the heat exchanger 4 the product is pumped through the pipeline 5 by a sterile pump 6 to a filling and forming pipe 7 which may have a circular, rectangular or square cross-section. During the passage through the filling and forming pipe 7 the shape of the inner contour of the pipe is imparted to the product while at the same time the product is cooled. At the bottom end of the pipe 7 cooling coils 8 arranged around the pipe cool the product. When the product, advanced successively with the help of the pump 6, has reached the bottom part 9 of the pipe 7, the product has solidified in such a manner that it forms a coherent mass. When squeezed out from the bottom opening 10 of the pipe 7, the product retains its shape corresponding to the inner contour of the pipe 7.

It is thus the principle to allow the sterilized fish mass to coagulate in the pipe 7, which coagulation may be hastened by forced cooling, and, after it has solidified, to extrude the product through the opening of the pipe while retaining its shape. The solidification of the product is furthered because the product is pushed into the pipe 7 under pressure so that a compact and homogeneous mass is obtained. For this purpose it will be necessary, so as to prevent continuous feeding of product from the bottom opening 10 of the pipe, to arrange a shut-off device or valve in the pipe 7. Such a shut-off device or valve may be constituted of a rotary disc 11 which at the same time acts as a cut-off knife for the strand of product in the manner described below.

With reference now also to FIG. 2, the actual filling and forming pipe 7 is terminated by a narrow gap 12, and a lower pipe portion 13, which is arranged below the gap, constitutes an extension of the lower pipe portion 7. The pipe portion 13 is of the same shape and has the same cross-sectional dimensions as the pipe portion 7, but the lower pipe portion 13 is considerably shorter. More precisely the lower pipe portion 13, is of a length which is similar to or smaller than the height of the packing container 16 which is intended to be filled with the sterilized product. In the gap between the lower pipe portion 7 and the pipe portion 13 the disc 11, acting as a knife, should be able to swing in, so as to cut off the product strand. At the same time, the disc 11 in the swung-in position will form an end wall in the end part of the pipe portion 7. The lower pipe portion 13, whose inner space 15 substantially corresponds to the space of the packing container 16, is provided at its lower end part with flaps 14. The lower end part also may consist of a swinging disc, like the knife disc 11. In the embodiment shown here, however, the flaps 14 are swingable about axes which are perpendicular to the longitudinal axes of the pipes 7 and 13, so that the flaps 14 can be swung out to stretched position when the lower end part of the pipe portion 13 is opened.

The filling and forming pipe construction described above is preferably partly arranged in a closed sterile chamber 25 wherein an atmosphere of sterile air is maintained under a slight pressure, e.g. by continuously blowing sterile-filtered air into the chamber 25.

In the sterile chamber is also arranged a conveyor belt 17 which is driven between two intermittently rotating wheels 18. On the conveyor belt 17, empty packing containers 16 may be arranged which are introduced into the sterile chamber through a first opening 26. In the sterile chamber or directly before the same, the insides of the packing containers are sterilized, e.g. in that a mist of hydrogen peroxide is sprayed down into the packing containers by means of a spraying nozzle 23. The packing containers 16 are made to move forward in an indexed movement owing to the conveyor belt 17 moving in steps, so as to advance the packages between the different treatment stations. After the sterilization with hydrogen peroxide, the package 16 is displaced to the next station, where a radiant heat source 24 heats up the inside of the package and evaporates the hydrogen peroxide. It is also possible at this station to blow in warm sterile air instead, so as to dry and evaporate the hydrogen peroxide.

After a further indexing step, the sterilized packing container 16 will be under the bottom opening of the lower pipe portion 13, the flaps 14 open and a piece of product strand, cut off with the help of the knife disc 11, is made to drop down into the packing container 16. As mentioned previously, the shape and the space of the pipe portion 13 correspond to the interior of the packing containers 16, so that the cut-off product portion contained in the lower pipe portion 13 substantially fills up the packing container 16 when the product portion is introduced into the same. In a further indexing step, the lugs 20 of the package are folded in and closed, so that the cut-off product portion 19 is enclosed bacteria-tight in the packing container. Finally the finished and closed package 21, containing the filled-in material, is removed from the sterile chamber 25 through a second opening 27.

The function of the forming and filling pipe 7 and its extension 13 can be described in more detail with reference to FIG. 2 and 3. For the sake of clarity the same detail references have been used in FIG. 2 and 3 as in FIG. 1.

In FIG. 2 the knife disc 11 is shown in swung-out position and the flaps 14 in swung-in or closed position. The solidified product is then fed downwards by means of the pressure which is applied by the pump 6 through the pipe 7 and the pipe portion 13, through the opening of which, however, the mass will not issue, since the flaps 14 are closed. Since the gap 12 is relatively narrow, only a few millimeters or parts thereof, and the product mass is relatively solid, the mass will not be pressed out through the gap 12, in spite of the pressure on the product prevailing in the pipe portions 7 and 13. When the portion of pipe, which has the length A, corresponding to or being somewhat less than the height of the packages 16, is wholly filled with the sterile and coagulated product, the knife disc 11 is swung through the gap 12, and the product strand is cut off. At the same time, the knife disc 11 forms an end wall at the bottom part of the pipe portion 7. During this time, as shown in FIG. 3, a previously sterilized packing container 16 has been advanced directly underneath the pipe portion 13, and when the flaps 14 are opened, the cut-off product piece 19 drops down into the packing container 16. The packing container 16, thus filled, is displaced after the filling to the closing station mentioned earlier, while the flaps 14 on the pipe portion 13 are closed again, and the knife disc 11 is swung out to the position shown in FIG. 2. The strand of coagulated product is fed at such a rate that it fills again the pipe portion 13, whereupon the knife disc 11 is swung in through the gap 12 and the process is repeated.

The heat treatment of the product need not necessarily be carried out in a special sterilizer, but it is conceivable that the pipe portion 7 could be extended and the upper part of the pipe 7, as shown in FIG. 1, be provided with a heating element 22, the product being heat-sterilized during its passage through the pipe 7. Naturally, the pipe 7 would then have to be extended considerably, and it is conceivable that the pipe 7 could be divided into two or more heating zones, the bottom part of the pipe 7 being a cooling zone. To obtain a homogeneous heating of the product it is also possible to arrange on the upper part of the pipe 7 opposed metal sidewalls, insulated from each other and from the rest of the pipe through being enclosed in an insulating material, e.g. glass or ceramic. The opposed and insulated wall plates on the pipe portion 7, could be used as electrodes for conducting an electric current through the product mass, which, during its passage between the said electrodes in the pipe 7, is heated to sterilization. It is an advantage of the latter method, that the heat is generated in the product mass which will thus obtain a homogeneous heating. It is necessary, however, to ensure that the temperature difference between the inside walls of the pipe 7 and the product is less than 100° C., since otherwise there is a risk of burns occurring on the inside of the pipe.

It is also possible to heat the food product in the pipe 7 by high-frequency heating, a high-frequency electromagnetic field being generated in a portion of the inner space of the pipe 7.

If the product is heated in the pipe 7, the pressure in the pipe 7 must be such that the formation of steam in the product is prevented in spite of the same being heated homogeneously to a temperature substantially exceeding 100° C. The pressure is maintained by the pump 6, which presses the finely divided, fluid or semi-fluid product forwards in the pipe 7.

If necessary, the product may be finely divided again through milling in the pump 6 or in a specially arranged grinding mill, not shown here, before the product mass is pushed into the pipe 7.

The description given here is only intended to illustrate the invention and it is possible of course within the scope of the concept of the invention to introduce a number of modifications. Thus the description of the sterile chamber and the sterilization and closing of the packages has only been sketched out, and the sterilization of the packages may take place in optional manner by known methods, which e.g. may include sterilization by means of electronic irradiation etc. Furthermore it is possible in certain cases completely to exclude the sterile chamber, or merely arrange some screen structure around the bottom parts of pipes 7 and 13 so as to prevent reinfection of the sterilized product. The method and arrangement in accordance with the invention have been found to operate satisfactory, and thus offer a possibility of preparing and packaging a product which it has not been possible previously to prepare. By the use of the method and apparatus of the present invention it becomes possible to sterilize and at the same time package under aseptic conditions a food product, in such a manner that the packages are given a very long keeping quality.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention.

I claim:

1. A method for the continuous preparation and packing of fish or meat food products, comprising the sequential steps of:

grinding said food product;

sterilizing said food product;

imparting a desired outer shape to said food product by continuously urging the food product through an internally sterile filling and forming pipe having a cross-section of a packing container provided with closable flap sections;

compressing the food product in the pipe;

thickening said compressd food product by passing the food product through a cooling section of the pipe;

advancing said compressed and thickened food product toward an opening of said filling and forming pipe;

closing said opening of said filling and forming pipe by swinging two flap portions attached to said filling and forming pipe toward each other;

cutting off a predetermined length of said compressed and thickened food product in said pipe and above said opening to form a food product portion having a size and a shape corresponding to a storage area defined by the packing container while simultaneously temporarily shutting off the continuous flow of the remainder of said compressed and thickened food product in the pipe to said opening of said filling and forming pipe;

advancing the packing container through a plurality of stations in indexed steps;

sterilizing the storage area of said container at one of said plurality of stations;

opening said filling and forming pipe by swinging said two flap portions away from each other;

depositing said food product portion into said container at another one of said plurality of stations;

closing said opening of said filling and forming pipe by swinging the two flap portions toward each other while sumultaneously allowing the flow of the remainder of the compressed and thickened food product in the pipe to continue to the opening of the filling and forming pipe;

closing said container under aseptic conditions, after said food product is deposited therein; and repeating said sequential steps to aseptically package a plurality of said food product portions.

2. The method of claim 1 wherein said sterile food product is first ground, then thickened a first time, before undergoing said grinding step.

3. The method of claim 1 further comprising the steps of:

further heating said food product in said filling and forming pipe after the step of compressing the food product;

subsequently cooling said food product in said filling and forming pipe; and wherein a temperature difference between an inside wall surface of said filling and forming pipe and said food product is less than 100° C.

* * * * *